US006789913B2

(12) United States Patent
Wei

(10) Patent No.: US 6,789,913 B2
(45) Date of Patent: Sep. 14, 2004

(54) MULTIFUNCTIONAL SHOE FLASHING DEVICE

(76) Inventor: Meng Pi Wei, 3F, No. 238, Pao Ping Rd., Yungho City, Taipei Hsien (TW)

( * ) Notice: Subject to any disclaimer, the term of this patent is extended or adjusted under 35 U.S.C. 154(b) by 0 days.

(21) Appl. No.: 10/173,397

(22) Filed: Jun. 18, 2002

(65) Prior Publication Data

US 2003/0231513 A1 Dec. 18, 2003

(51) Int. Cl.[7] ..... F21V 21/08

(52) U.S. Cl. ..... 362/103; 362/231; 362/800; 36/137

(58) Field of Search ..... 362/800, 103, 362/230, 231, 802, 394, 278, 240, 251; 36/137

(56) References Cited

U.S. PATENT DOCUMENTS

| | | | | | |
|---|---|---|---|---|---|
| 4,848,009 | A | * | 7/1989 | Rodgers | 36/137 |
| 5,033,212 | A | * | 7/1991 | Evanyk | 36/137 |
| 5,381,615 | A | * | 1/1995 | MacMillan | 36/137 |
| 5,483,759 | A | * | 1/1996 | Silverman | 36/137 |
| 5,599,088 | A | * | 2/1997 | Chien | 362/103 |
| 5,644,858 | A | * | 7/1997 | Bemis | 36/137 |
| 5,746,499 | A | * | 5/1998 | Ratcliffe et al. | 362/103 |
| 5,821,858 | A | * | 10/1998 | Stone | 340/573.1 |
| 6,017,128 | A | * | 1/2000 | Goldston et al. | 362/103 |
| 6,104,140 | A | * | 8/2000 | Wut et al. | 315/200 A |
| 6,280,045 | B1 | * | 8/2001 | Anteby et al. | 362/103 |
| 6,525,487 | B2 | * | 2/2003 | Wei | 315/200 A |
| 2002/0048169 | A1 | * | 4/2002 | Dowling et al. | 362/234 |
| 2002/0101730 | A1 | * | 8/2002 | Dilger et al. | 362/91 |

FOREIGN PATENT DOCUMENTS

| | | | | |
|---|---|---|---|---|
| JP | 11354847 | A | * 12/1999 | H01L/33/00 |

* cited by examiner

*Primary Examiner*—Thomas M. Sember
*Assistant Examiner*—Hargobind S. Sawhney
(74) *Attorney, Agent, or Firm*—Rosenberg, Klein & Lee

(57) ABSTRACT

A multifunctional shoe flashing device includes at least one casing, at least one battery, a substrate, a conductive wiring, a lighting device, an oscillation switch, and a control circuit. The conductive wiring has one end connected to the substrate and the other end protruding from the casing and connecting to the lighting device, which includes three lighting chips. When the casing is affected due to external forces, the control circuit is triggered to activate flashing of the lighting device in a sequential and non-overlapping manner within a predetermined time period by setting predetermined mixed color and time ratios.

11 Claims, 5 Drawing Sheets

MULTIFUNCTIONAL SHOE FLASHING DEVICE

BACKGROUND OF THE INVENTION

1. Field of the Invention

The present invention relates to a multifunctional shoe flashing device. More particularly, the present invention relates to a light source installed in a shoe, wherein after setting mixed LED with proper mixed color ratios and mixed time ratios, the white color is presented when the shoe is still, and red, green, and blue colors are presented while moving.

2. Description of the Prior Art

Shoes with lighting devices therein have been provided nowadays. When people wearing the shoes move back and forth while dancing or walking, circuits within the shoes provide certain functions such as flashing on and off. Such shoes are very useful and may provide enhanced safety to users for many situations.

Please refer to FIG. 1 of a schematic diagram showing a typical shoe illumination device 1*a*. A switch 10*a* is serially connected a power supply with a light emitted diode (LED) 11*a*. A casing is used to protect these devices. Electrical powers are transferred from the power supply to the LED 11*a* when the shoe illumination device la is driven by external forces. However, the defect of this shoe illumination device 1*a* is the flashing of the LED 11*a* is not changed.

Referring to FIG. 2 of a schematic diagram showing another shoe illumination device 2*a*. The device 2*a* is connected to an input terminal of a control unit 21*a* through a button 20*a*. A LED 22*a* is electrically connected to an output terminal of the control unit 21*a*. The internal circuit of the control unit 21*a* receives a triggering signal from the button 20*a* and activates the LED 22*a* to present four flashing types. A 1 to 5-second pause is arranged every two flashings. However, with only one monochrome LED in this embodiment still cannot have a variety of colors.

Recently, with the development of mixed color LEDs, it is possible to apply these full color light sources to shoes for the purpose of presenting a variety of colors.

SUMMARY OF THE INVENTION

It is a primary objective of the present invention to provide a multifunctional shoe flashing device capitalizing on mixed color LEDs in combination with an oscillation switch. After setting mixed LED with proper mixed color and time ratios, the white color is presented when the shoe is still, and red, green, and blue colors are presented while a user is moving the shoe.

Another objective of the present invention is when the oscillation switch is pressed due to external forces, a control circuit is triggered to activate continuous flashing of various colors.

According to the claimed invention, a multifunctional shoe flashing device includes at least one casing, at least one battery, a substrate, a conductive wiring, a lighting device, an oscillation switch, and a control circuit. The conductive wiring has one end connected to the substrate and the other end protruding from the casing and connecting to the lighting device, which includes mixed color LEDS having three original-color lighting chips, and wherein when the casing vibrates due to external forces, the control circuit is triggered to activate flashing of the lighting device in a sequential and non-overlapping manner within a predetermined time period.

It is to be understood that both the forgoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENT

Figure 1:
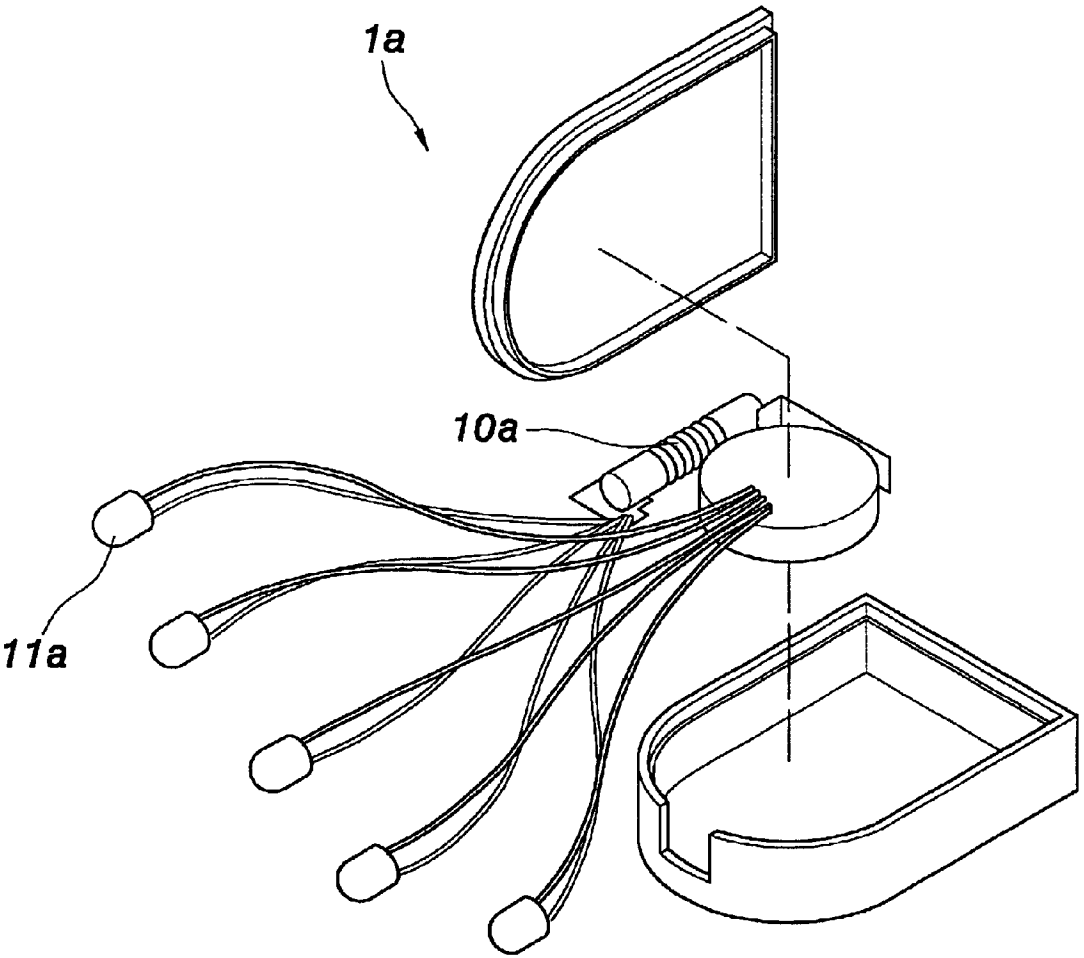
FIG. 1 PRIOR ART
FIG. 1 is a schematic diagram of a prior art shoe illumination device.
Figure 2:
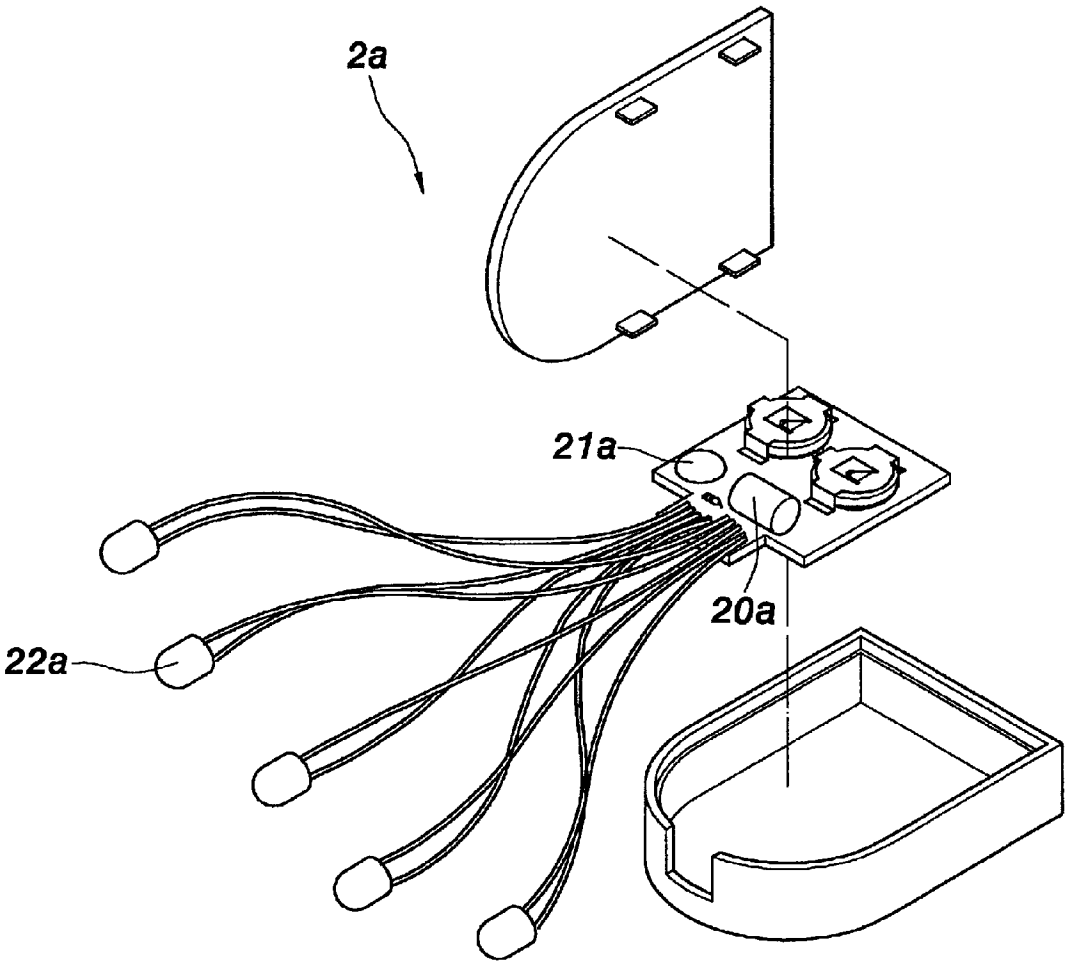
FIG. 2 PRIOR ART
FIG. 2 is another schematic diagram for another kind of shoe illumination device.
Figure 3:
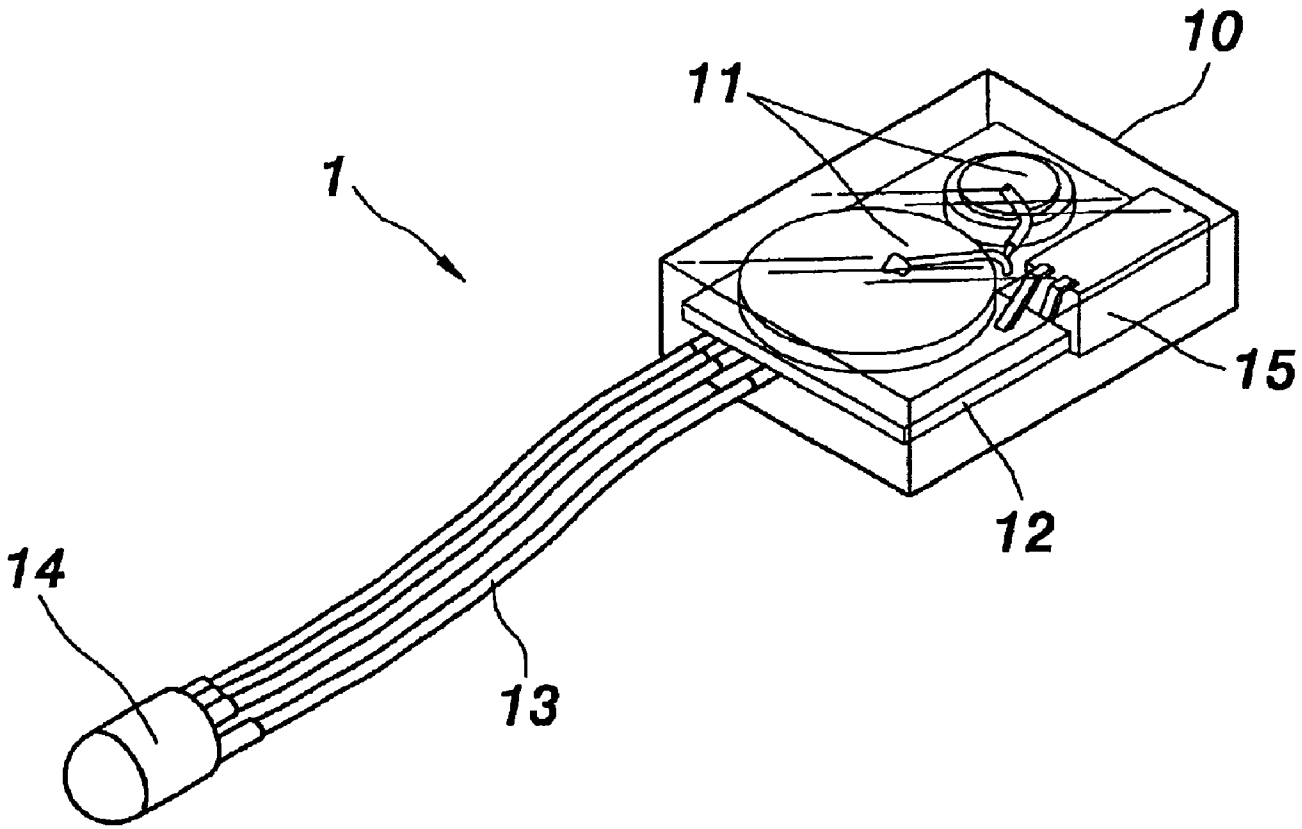
FIG. 3 is an exploded diagram showing the components of this invention.

Please refer to FIG. 3. FIG. 3 is an exploded diagram of the present invention. The present invention is directed to a multifunctional shoe flashing device 1 including a casing 10, at least one battery 11, such as a lithium battery or a mercury battery, a substrate 12, a conductive wiring 13, a lighting device 14, an oscillation switch 15, and a control circuit 16.

The battery 11, which provides a DC voltage of 3V and 4.5V, and the substrate 12 are encapsulated by the casing 10. The conductive wiring 13 has one end connected to the substrate 12 and the other end protruding from the casing 10 and connecting to the lighting device 14. The lighting device 14 is a mixed color LED having three lighting chips of red, green, and blue colors. The oscillation switch 15 is an oscillation resistor. When the casing 10 is affected due to external forces, like vibration, the control circuit 16 is triggered to activate flashing of the lighting device in a sequential and non-overlapping manner within a predetermined time period.

Figure 4:
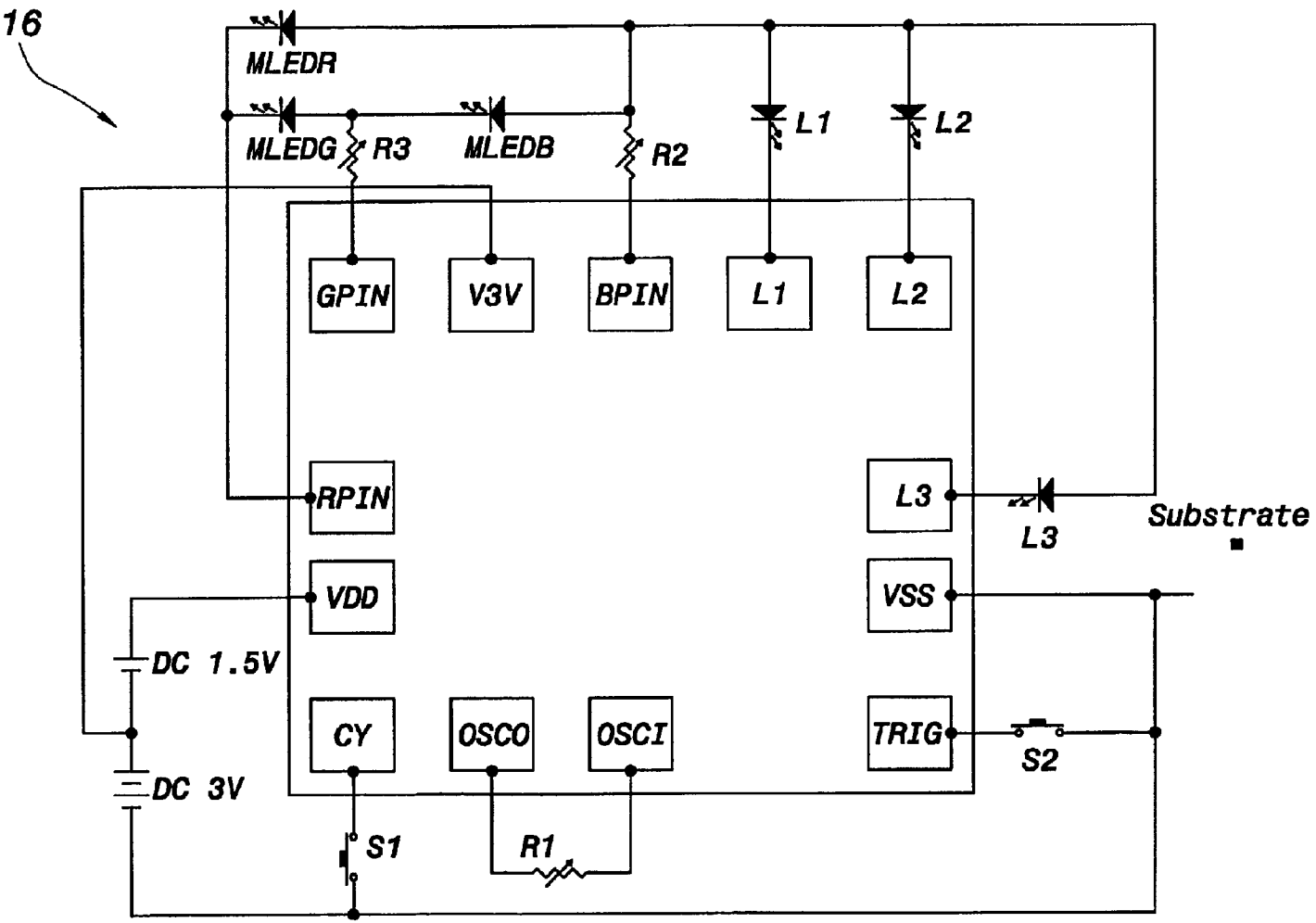
FIG. 4 is a circuit diagram according to this invention.

Referring to FIG. 4 of circuit layout of the control circuit 16. Pins L1~L3 are output pins reserved for the monochrome LED. Pins of BPIN, GPIN, and RPIN are output pins for the mixed color LED to connect with the above-mentioned three lighting chips of MLED1, MLED2, and MLED3 respectively. Pin V3V is a positive electrode of the 3V DC power supply. Pin VDD is the positive electrode of the 4.5V DC battery. Pin VSS is the negative electrode of the power supply. Pin TRIG is provided for the one-shot or the level trigger operation. Pin CY is provided for triggering the switch.

The lighting device 14 flashes according to human's 1/16 to 1/24-second persistence of vision. The flashing types of the lighting device include:

(1) TRIG is grounded instantly to flash the lighting device 14 in a sequential manner for one time. The mixed ratio of three lighting chips is 5:6:7. The mixed time ratio for these lighting chips is 7.812:9.375:10.937 (ms). With this configuration, the flashing sequence will follow the red-blue-green-red-blue-green cycle until the end of flashing time. The user will realize that when the shoe is still, the lighting device 14 present a white light. When the shoe is moved, the red-blue-green flash light can present. Further, pin TRIG triggers the lighting device 14 to receive the next signal after a 0.3-second interval. Moreover, a pulse signal can be input through pin CY to flash the lighting device 14 in the above-mentioned sequential manner until the next pulse signal is input.

(2) Pin TRIG is grounded instantly. The lighting device 14 flashes in a sequential manner for one time. The mixed color ratio of three lighting chips is as follows (recursive for eight times):

| | Red chip | Blue chip | Green chip |
|---|---|---|---|
| Blue | 0 | 16 | 0 |
| Red | 16 | 0 | 0 |
| White | 0 | 1 | 17 |
| Orange | 8 | 0 | 8 |
| Green | 0 | 0 | 16 |
| Purple | 9 | 7 | 0 |

The mixed time ratio is as follows (ms):

| | Red chip | Blue chip | Green chip |
|---|---|---|---|
| Blue | 0 | 24 | 0 |
| Red | 24 | 0 | 0 |
| White | 0 | 1.5 | 25.5 |
| Orange | 12 | 0 | 12 |
| Green | 0 | 0 | 24 |
| Purple | 13.5 | 10.5 | 0 |

With this configuration, the flashing will be a blue-red-white-orange-green-purple flashing cycle. Further, pin TRIG triggers the lighting device 14 to receive next signal after finishing a full flashing cycle. Moreover, a pulse signal can be input through pin CY to flash the lighting device 14 in the above-mentioned sequential manner until the next pulse signal is input.

Figure 5:
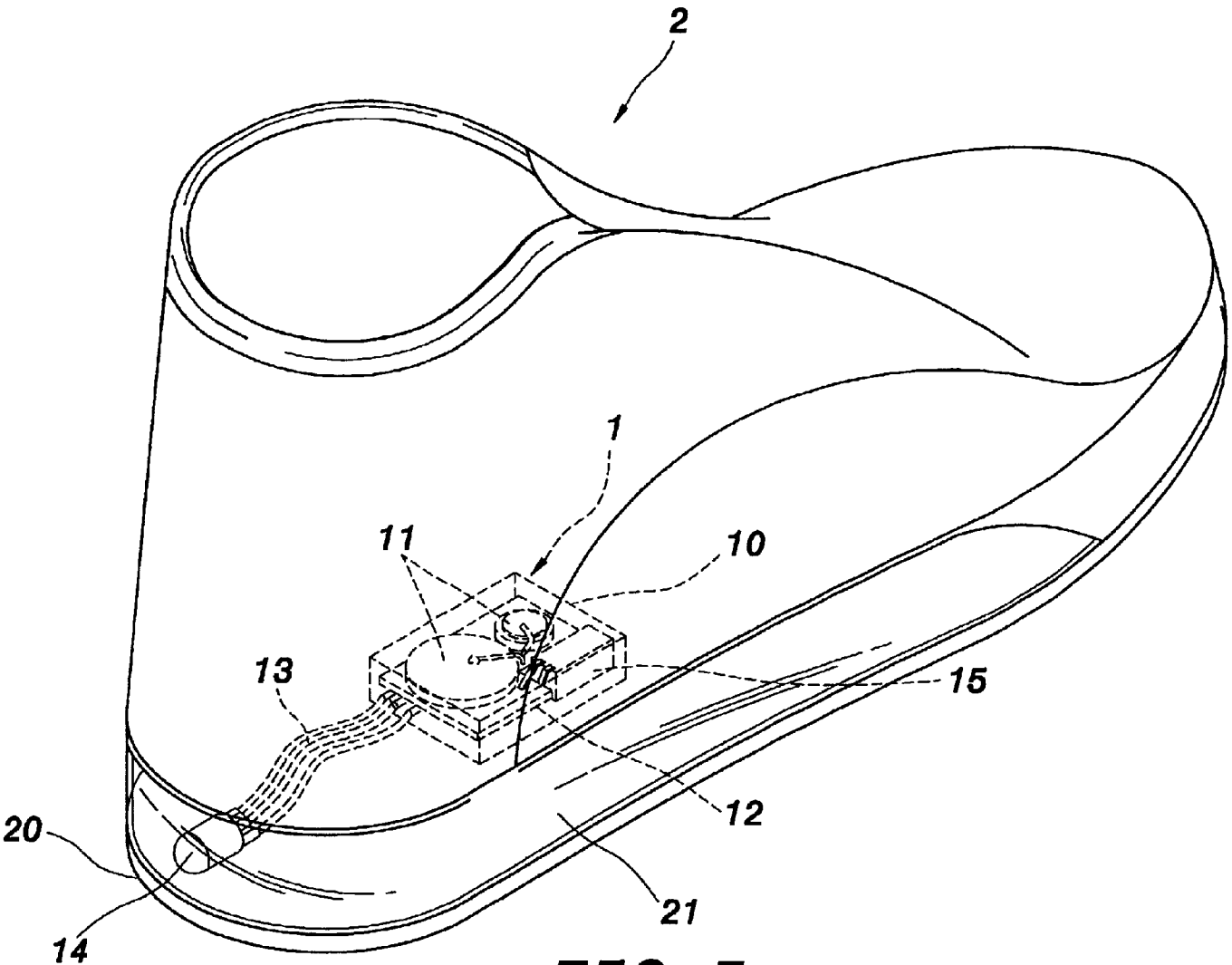
FIG. 5 is a schematic diagram showing the use of this invention.

Please refer to FIG. 5. The device of this invention is installed in a heel 20 of a shoe body 2. A strip made of light transmissible material 21 such as silicone rubber having light guiding function is disposed on the peripheral of the shoe body 2. When a user wearing the shoes with this device, by pressing the oscillation switch 15 as he jumps, walks, or runs, the lighting device 14 flashes and emits light through the light transmissible material 21 so as to present the white light or the full color light. The control circuit 16 changes operation period of the lighting device 14 and thus alters the colors of the shoes. By mixing different colors of light, the shoe according to the present invention can present various combinations of light based on R, G, and B lighting chips. Comparing with prior arts, the present invention provides decorative and versatile color combination functions.

It should be understood that the position of the device of this invention does not limit the protective scope of the present invention. The device may be installed at the bottom peripheral, the front part, or the surface of the shoes. The device can be installed on other sport apparatuses such as a skate or a skateboard.

Further, the light transmittable material 21 may be shaped into various figures and integrated with many patterns, letters. In some cases, the lighting device 14 is covered by a covering with various patterns.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A multifunctional shoe flashing device installed in a shoe body, the shoe flashing device comprising at least one casing, at least one battery, a substrate, conductive wiring, a lighting device, an oscillation switch, and a control circuit, wherein the conductive wiring respective has one end connected to the substrate and another end protruding from the casing and connected to the lighting device, the lighting device including three lighting chips of different colors, wherein when the casing is affected due to external forces, the control circuit is triggered to activate flashing of the lighting device in a sequential and non-overlapping manner within a predetermined time period, the three lighting chips respectively emitting red, green, and blue light, the control circuit activating the three lighting chips with a predetermined mixed color ratio and a predetermined mixed time ratio, a white light being perceived from the lighting device when the shoe body is still, and at least red, green, and blue color light being perceived from the lighting device when the shoe body is in motion.

2. The multifunctional shoe flashing device of claim 1 wherein the lighting device is a mixed color LED.

3. The multifunctional shoe flashing device of claim 1 wherein the lighting device is installed at a position independent of a position of the casing.

4. The multifunctional shoe flashing device of claim 1 further comprising a strip of a light transmissible material around the peripheral of the shoe body for placing the lighting device.

5. The multifunctional shoe flashing device of claim 1 wherein the lighting device is covered by a covering.

6. The multifunctional shoe flashing device of claim 1, wherein after setting the three lighting chips of different colors with a predetermined mixed color ratio and a predetermined mixed time ratio, the lighting device flashes in a sequential manner with various colors.

7. The multifunctional shoe flashing device of claim 1 wherein the battery is a lithium battery or a mercury battery.

8. The multifunctional shoe flashing device of claim 1 wherein the oscillation switch is an oscillation resistor.

9. The multifunctional shoe flashing device of claim 1 wherein control circuit further connects with a plurality of monochrome LEDs.

10. The multifunctional shoe flashing device of claim 1 wherein the predetermined time period is less than or equal to a human's persistence of vision of 1/16 of a second.

11. A multifunctional shoe flashing device installed in a shoe body, the shoe flashing device comprising at least one casing, at least one battery, a substrate, conductive wiring, a lighting device, an oscillation switch, and a control circuit, wherein the conductive wiring respectively has one end connected to the substrate and another end protruding from the casing and connected to the lighting device, the lighting device including three lighting chips of different colors, the control circuit activating flashing of the three lighting chips in a sequential and non-overlapping manner within a predetermined time period responsive to the casing being affected by external forces, the predetermined time period being less than a persistence time period of a human eye when the shoe body is in a static state to provide a perception of white light being emitted from the lighting device and the predetermined time period being varied with respect to a persistence time period of a human eye when the shoe body is in a moving state to provide the perception of greater than three individual colors being sequentially emitted from the lighting device.

* * * * *